US005407904A

United States Patent [19]

Das

[11] Patent Number: 5,407,904

[45] Date of Patent: Apr. 18, 1995

[54] HIGH TC SUPERCONDUCTING HIGH POWER FILTERS

[76] Inventor: Satyendranath Das, P.O. Box 6223, Washington, D.C. 20015-0223

[21] Appl. No.: 105,620

[22] Filed: Aug. 13, 1993

[51] Int. Cl.[6] ..... H01P 1/208; H01P 1/209; H01B 12/02

[52] U.S. Cl. ..... 505/210; 505/700; 505/866; 333/99 S; 333/212

[58] Field of Search ..... 333/99 S, 212; 505/202, 505/204, 210, 700, 701, 866

[56] References Cited

U.S. PATENT DOCUMENTS

| | | | |
|---|---|---|---|
| 4,849,724 | 7/1989 | Koreeda | 333/212 |
| 5,268,659 | 12/1993 | Zaki et al. | 333/212 X |

FOREIGN PATENT DOCUMENTS

| | | | |
|---|---|---|---|
| 226951 | 7/1987 | European Pat. Off. | 333/212 |
| 68101 | 3/1989 | Japan | 333/229 |
| 251903 | 10/1989 | Japan | 333/229 |
| 46701 | 3/1993 | Japan | 333/212 |
| 2235828 | 3/1991 | United Kingdom | 505/866 |

*Primary Examiner*—Benny T. Lee

[57] ABSTRACT

To reduce the losses, high Tc superconductive waveguide filters are disclosed. There are two approaches to make the filters. In the first approach, all waveguide sections, irises, flanges are made of a single crystal high Tc superconductor. The single crystal is machined to the desired shape and size, the pieces are brazed and connected with flanges. In the second approach all waveguide sections, irises and flanges are made of a single crystal dielectric material the conducting surfaces of which are deposited with a film of a single crystal high Tc superconductor. The waveguide sections, irises and flanges are connected together by brazing or by a similar method. There are two basic types, (1) band pass and (2) band reject, of filters. In the band pass type, a series of resonators are placed one after another with a separation, typically, of three quarters of a wavelength between the centers of adjacent resonators. In the band reject filters, the resonators are in branch lines, i.e., on the broad wall of the main waveguide with a separation, typically, of three quarters of a wavelength between the centers of adjacent resonators.

6 Claims, 2 Drawing Sheets

HIGH TC SUPERCONDUCTING HIGH POWER FILTERS

FIELD OF INVENTION

1. The present invention relates to filters of electromagnetic waves and more particularly to RF filters.

2. In many fields of electronics, it is necessary to filter or pass or block signals dependent on their frequencies.

For high power applications, waveguide filters are used. In one configuration, one or more waveguide resonators are used and they are connected through waveguides. In the band-pass version, the waveguide resonators and the waveguide sections are connected one after another in a chain. W. W. Mumford, "Maximally-flat filters in Waveguide," Bell System Technical Journal, pp. 684–712, 1948. Waveguides and resonators are generally built of copper sometimes with gold plating on the conducting surfaces. These filters have finite losses which increase with increasing number of sections used.

In the stop-band or band-reject or band-elimination version of the filter, a main waveguide section is used and waveguide resonators are placed on the top of the broad-wall of the waveguide with a section of waveguide in between them. The waveguides and the resonators are generally built of copper sometimes with gold plating on the conducting surfaces. These filters have finite losses which increase with the increasing number of sections used. P. A. Rizzi, Microwave Engineering passive circuits, Prentice Hall, Engelwood Cliffs, N.J. 07632, pp. 457–462.

In the high Tc superconducting high power filter, the conducting surfaces are made of a high Tc superconducting material significantly reducing the losses. In one version, the waveguides and the waveguide resonator(s) are made of a high Tc superconducting single crystal material such as YBCO. In another version, the waveguides and the waveguide resonator(s) are made of a good quality single crystal dielectric such as sapphire the conducting surfaces of which are deposited with a film of a single crystal high Tc superconducting material such as YBCO. The waveguide flanges are made of a single crystal high Tc superconducting material. The waveguides and the resonator(s) are connected through waveguide flanges or are brazed at the connecting sections. The surface resistance of these devices are reduced at least by a factor of ten by the use of high Tc superconducting material. Low loss filters are particularly important for high power as well as low-noise applications. Significant amount of RF power is lost, even with a low loss filter. The high Tc superconducting filters will provide a significant benefit in high power and very low noise large antenna earth station, such as INTELSAT, systems.

SUMMARY OF THE INVENTION

The purpose of the present invention is to provide filters with losses significantly lower than the conventional room temperature filters of comparable design.

The band-pass filters are made of sections of waveguide resonators with sections of waveguide in between them. The band-stop filters are made of a section of waveguide with waveguide resonator(s) connected on the broad-wall of the main waveguide with waveguide sections in between the resonators. The interior conducting surfaces of the waveguide(s) and the waveguide resonator(s) have high Tc superconducting material and the waveguide flanges have high Tc superconducting material on the conducting surfaces.

One purpose of this invention is to lower the the losses of the filters below those of the conventional room temperature filters of comparable design. Another object of this design is to design high power filters to handle power levels of at least 0.5 Megawatt. G. Shen, C. Wilker, P. Pang and W. L. Holstein," "High Tc Superconducting-sapphire Microwave resonator with Extremely High Q-Values Up To 90K," IEEE MTT-S Digest, pp. 193–196, 1992.

These and other objectives are achieved in accordance with the present invention. The waveguide resonators are, generally, operated in the dominant mode. For the rectangular waveguide the dominant mode is $TE_{101}$. The waveguide resonator, in the rectangular waveguide case, has a length which is typically one half the guide wavelength with irises, which could be inductive or capacitive. The presence of the irises changes the resonant frequency of the waveguide resonators. The separation, measured between the centers of the adjacent waveguide resonators, between the resonators is typically three quarters of a guide wavelength. The interior conducting surfaces of the waveguides and the waveguide resonators are deposited with a film or made of a single crystal high Tc superconducting material such as YBCO. There are two approaches to this. In one, each waveguide section and the waveguide resonator, the waveguide flange, and iris is made of a high Tc superconducting single crystal such as YBCO. In the second version, each waveguide section, waveguide resonator, waveguide flange and the iris is made of a good quality single crystal dielectric such as sapphire the interior conducting surfaces of which are coated with a film of a single crystal high Tc superconducting material such as YBCO.

With these and other objectives in view, as well hereinafter be more particularly pointed out in detail in the appended claims, reference is now made to the following description taken in connection with accompanying diagrams.

DESCRIPTION OF THE PREFERRED EMBODIMENTS

Figure 1:
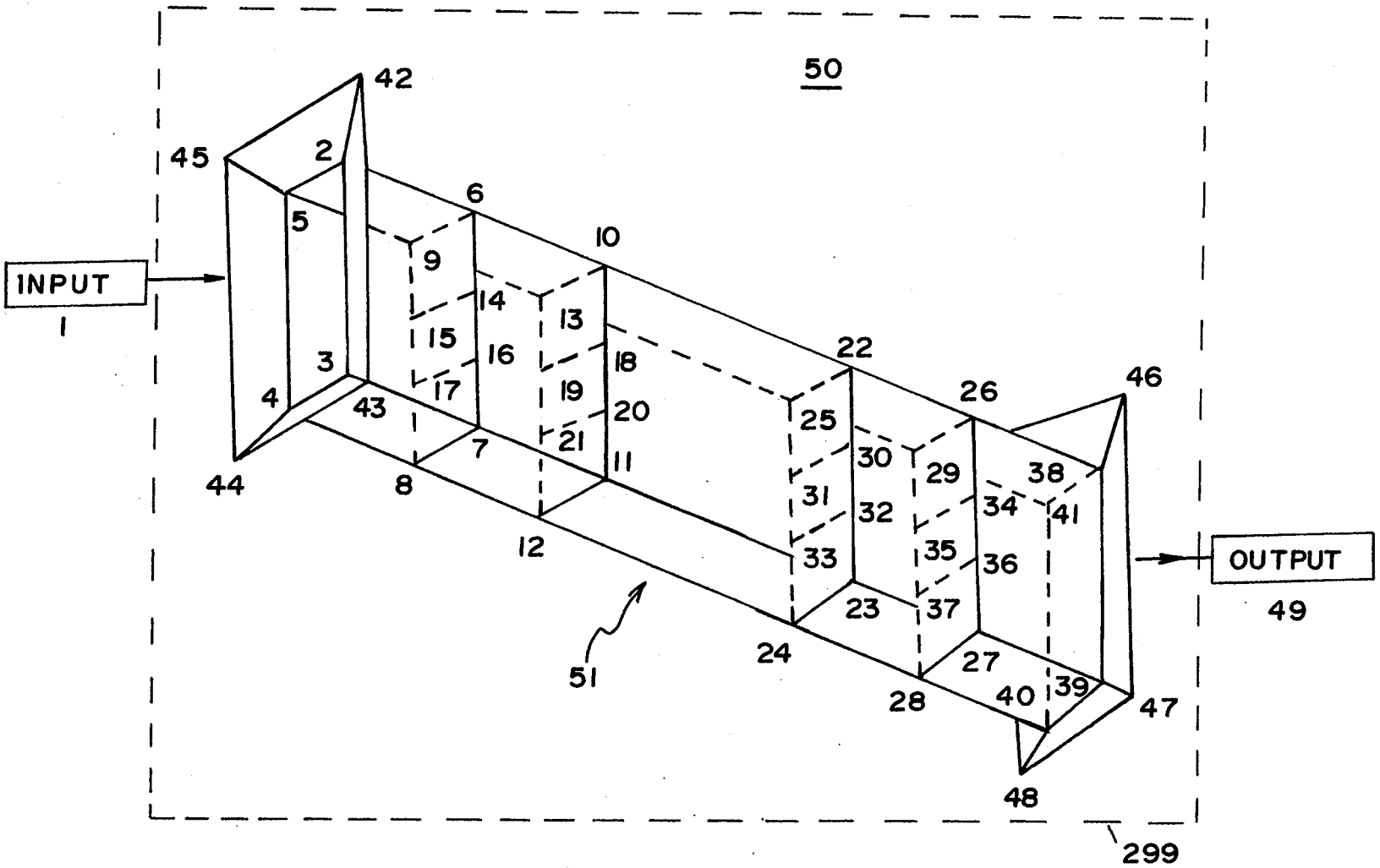
FIG. 1 is a typical, pictorial, schematic embodiment of an inventive band-pass filter.

Now referring to the drawings, there is illustrated in FIG. 1, a typical microwave or millimeter wave configuration that incorporates the principles of this invention. Circuit 50 includes an RF input 1, an RF transmission line 51 and an RF output 49.

The circuit 50 might be a part of a cellular, radar, terrestrial microwave, satellite, radio navigation, radio determination or other telecommunication system. The RF input 1 may represent a signal generator or a transmitter which launches a telecommunication signal onto a transmission line 51 for transmission to an output 49.

The high Tc superconducting high power filter is made of a number of section(s) of waveguide and waveguide resonator(s) the conducting surfaces of which are made of or are deposited with a .film of a single crystal high Tc superconducting material.

The transmission line 51 contains an input high Tc superconducting waveguide section 2, 3, 4, 5. This is followed by a high Tc superconducting waveguide resonator bounded by two thin conducting plates or fins 6, 7, 8, 9 and 10, 11, 12, 13. Inductive irises 14, 15, 17, 16 and 18, 19, 21, 20 provide input and output coupling of the signal through the waveguide resonator. The sizes of the irises are determined by several factors one of which is the power handling capability. The length of the waveguide resonator is typically one half of a guide wavelength. The resonant frequency of the resonator is changed by the dimensions of the irises.

In the transmission line 51, there is a second high Tc superconducting waveguide resonator separated by a high Tc superconducting waveguide section bounded by plates or fins 10, 11, 12, 13, and plates or fins 22, 23, 24, 25. The high Tc superconducting waveguide resonator is bounded by plates or fins 22, 23, 24, 25 and plates or fins 26, 27, 28, 29. The holes of the input and the output high Tc superconducting irises of this second resonator are 30, 31, 33, 32 and 34, 35, 37, 36. The length of the second waveguide resonator is typically one half guide wavelength. The resonant frequency of the second resonator is changed by the dimensions of the irises. The separation between the centers of the two waveguide resonators is typically three quarters of a guide wavelength.

The output waveguide is 38, 39, 40, 41. Finally, the output is delivered at 49. The input high Tc superconducting waveguide flange is bounded by superconductive material 42, 43, 44, 45 and waveguide sections 2, 3, 4, 5. The input waveguide flange is connected to the input of the input waveguide section at 2, 3, 4, 5. The output waveguide flange is bounded by superconductive material 46, 47, 48 and output waveguide 38, 39, 40, 41. The output waveguide flange is connected to the output of the output waveguide section at 38, 39, 48, 41. All the conducting surfaces of the waveguide sections, waveguide resonators, irises and flanges are made of or are deposited with a film of a single crystal high Tc superconducting material such as YBCO.

In one embodiment, the waveguide sections, the waveguide resonators, irises and flanges are all made of a high Tc superconducting single crystal material such as YBCO. In a second embodiment, the waveguide sections, the waveguide resonators, irises and the waveguide flanges are all made of a good quality single crystal dielectric such as sapphire and all conducting surfaces are deposited with a film of a high Tc superconducting single crystal material such as YBCO.

Only two cavities are shown in FIG.1 for simplicity. The high Tc superconducting high power band pass filters can have 1, 2, 3, 4 . . . , n number of resonators and 0, 1, 2, 3 . . . , (n−1) waveguide connecting sections in between them depending on the filter characteristics required.

Figure 2:
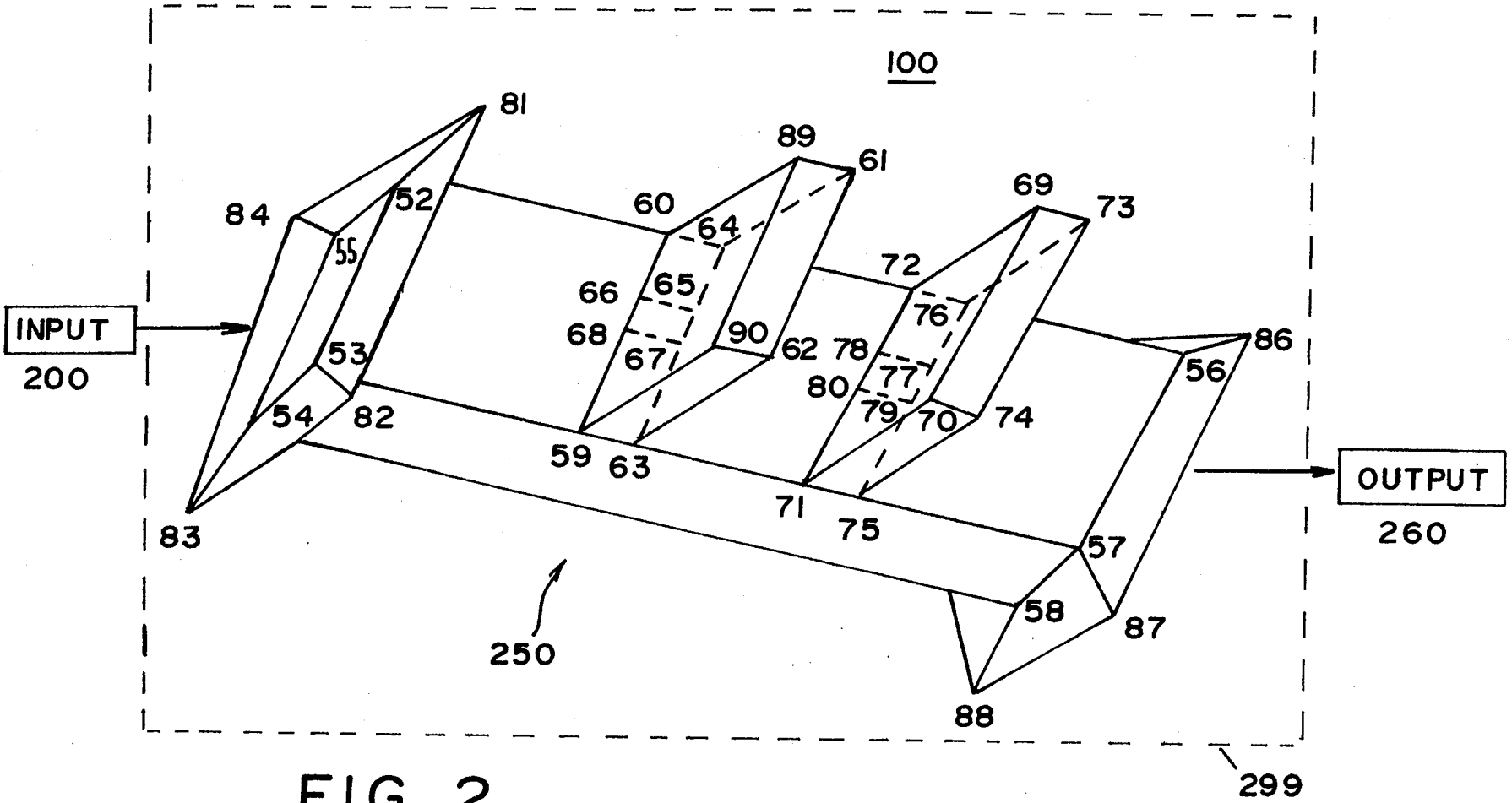
FIG. 2 is a typical, pictorial, schematic embodiment of an inventive band-reject filter.

There is illustrated in FIG. 2 a typical microwave or millimeter embodiment that incorporates the principles of the present invention. Circuit 100 includes an RF input 200, an RF transmission line 250 and an RF output 260.

The circuit 100 might be a part of a cellular, radar, terrestrial microwave, satellite, radio navigation, radio determination or other telecommunication system. The RF input may represent a signal generator or a transmitter which launches a telecommunication signal onto a transmission line 250 for transmission to an output 260.

The high Tc superconducting high power band-stop filter is made up of a number of section(s) of waveguide and waveguide resonator(s) the conducting surfaces of which are made up or deposited with a film of a single crystal high Tc superconducting material. The transmission line 250 contains an input high Tc superconducting waveguide section 52, 53, 54, 55 and an high Tc superconducting output waveguide section 56, 57, 58.

The first high Tc superconducting resonator is bounded by a waveguide section whose opposite sides are 89, 90, 59, 60 and 61, 62, 63, 64. The coupling iris between the high Tc superconducting waveguide resonator and the high Tc superconducting main waveguide is 65, 66, 68, 67. At the other end of the resonator is a short circuited high Tc superconductor plate 89, 61, 62, 90. The length of the waveguide resonator is typically one half guide wavelength. The resonant frequency of the resonator is changed by the dimensions of the iris. The dimensions of the iris are determined by several factors including the filter characteristics and power handling capability. The input high Tc superconducting waveguide flange is bounded by input waveguide section 52, 53, 54, 55 and superconductive materials 81, 82, 83, 84. The input waveguide flange is connected to the input of the input waveguide section at 52, 53, 54, 55. The output high Tc superconducting waveguide flange is bounded by output waveguide 56, 57, 58 and superconductive materials 86, 87, 88.

In the transmission line 250 is shown a second cavity. The separation between centers of the two adjacent cavities is typically three quarters of a guide wavelength at the operating frequency of the filter. The second high Tc superconducting resonator is bounded by a waveguide section whose opposite sides are 69, 70, 71, 72 and 73 74, 75, 76. At the other end of the resonator is a short circuited high Tc superconductor plate 69, 73, 74, 78. The coupling iris between the high Tc superconducting cavity and the main waveguide is 78, 77, 79, 80. The length of the second waveguide resonator is typically one half guide wavelength foreshortened by the reactance of the iris. The resonant frequency of the resonator is changed by the dimensions of the iris. The dimensions of the iris are determined by several factors including the filter characteristics, power handling capability.

All the conducting surfaces of the waveguide sections, waveguide resonators, irises and waveguide flanges are either made of or are deposited with a film of a single crystal high Tc superconducting material such as YBCO.

Element 299 is the means for keeping the filter at the high Tc superconducting temperature.

In one configuration, the waveguide sections, the waveguide resonators, irises, the waveguide flanges are all made of a high Tc superconducting single crystal material such as YBCO. In a second configuration, the waveguide sections, the waveguide resonators, irises, the waveguide flanges are all made of a good quality single crystal dielectric such as sapphire and all conducting surfaces are deposited with a film of a single crystal high Tc superconducting material such as YBCO.

The waveguide sections and the waveguide resonators are connected with waveguide flanges and or are brazed at the point of connections. To provide mechanical strength, the outside surfaces can be deposited with copper by electroforming.

Only two cavities are shown in FIG. 2 for simplicity. The high Tc superconducting high power band stop filters can have 1, 2, 3, 4 . . . , n sections of resonators and 0, 1, 2, 3 . . . , (n−1) sections of connecting waveguide section(s) in between them depending on the filter characteristics required.

These high Tc superconducting filters will also work at low power levels as well as high power levels.

It should be understood that the foregoing disclosures relate to only typical embodiments of the invention and that numerous modifications or alternatives may be made therein, by those of ordinary skill, without departing from the spirit and the scope of the invention as set forth in the appended claims.

What is claimed is:

1. A high Tc superconducting rectangular waveguide resonator band pass filter, having an input at one end and an output at the other end, a center in each resonator therebetween and comprising of:

a body of high Tc superconducting rectangular waveguide main transmission line;

a first high Tc superconducting transmission means for coupling RF energy into said body at the input;

a first high Tc superconducting rectangular waveguide resonator, typically being one half of a guide wavelength long and being part of the said main transmission line, with irises;

a second high Tc superconducting rectangular waveguide resonator, typically being one half of a guide wavelength long and being part of the said main transmission line, with irises;

a first high Tc superconducting rectangular waveguide section connected between the first and the second waveguide resonators providing a separation between centers of the resonators being typically three quarters of a guide wavelength long;

a third, fourth . . . , n high Tc superconducting rectangular waveguide resonators, each waveguide resonator typically being one half of a guide wavelength long and being part of the said main transmission line, with corresponding irises;

a second, third . . . , (n−1) high Tc superconducting rectangular waveguide sections, providing a respective separation between the centers of successive adjacent waveguide resonators of typically three quarters of a guide wavelength long, being connected to successive waveguide resonators, being part of the Said main transmission line, and being connected with the second waveguide resonator;

a second RF high Tc superconducting transmission means for coupling energy from said body at the output;

flanges being connected at the input and at the output of the filter on the main transmission line;

said first, second, third . . . , (n−1) high Tc superconducting rectangular waveguide sections each comprised of single crystal high Tc superconducting materials;

said first, second, third . . . , n high Tc superconducting rectangular waveguide resonators each comprised of single crystal high Tc superconducting materials;

each of the said high Tc superconducting irises comprised of single crystal high Tc superconducting materials;

each of said flanges comprised of single crystal high Tc superconducting materials; and means for keeping the high power band-pass filter at a high Tc superconducting temperature.

2. A high Tc supercoconductor band pass filter of claim 1 wherein the high Tc superconducting material being a single crystal YBCO.

3. A high Tc superconducting rectangular waveguide resonator band-reject filter, having branch resonators, an input at one end and an output at the other end, a center in each resonator therebetween and comprising of:

a body of high Tc superconducting main rectangular waveguide transmission line having a broad wall;

a first RF high Tc superconducting transmission means for coupling RF energy into said body at the input;

a first high Tc superconducting branch rectangular waveguide resonator, typically being one half of a guide wavelength long and being separate from the said main transmission line, being part of the branch resonator, with an iris and being connected to the broad-wall of the main waveguide;

a second high Tc superconducting branch rectangular waveguide resonator, typically being one half of a guide wavelength long and being separate from the said main transmission line, being part of the branch resonators, with an iris and being connected to the broad-wall of the main waveguide;

a first high Tc superonducting main rectangular waveguide section, connected between the first and the second waveguide resonators providing a separation between the centers of the resonators being typically three quarters of a guide wavelength long and being part of the main waveguide transmission line;

a third, fourth . . . , n high Tc superconducting rectangular waveguide resonators, each waveguide resonator typically being one half of a guide wavelength long and being separate from the said main transmission line and being part of the branch resonators, with corresponding irises and being connected to the broad wall of the main waveguide;

a second, third . . . , (n−1) high Tc superconducting rectangular waveguide sections, providing a respective separation, between the centers of successive adjacent waveguide resonators of typically three quarters of a guide wavelength long, being connected to successive waveguide resonators and being connected with the first waveguide section and being part of said the main waveguide transmission line;

a high Tc superconducting rectangular waveguide output section;

flanges being connected at the input and at the output of the band reject filter on the main rectangular waveguide transmission line;

said first, second, third . . . , (n−1) high Tc superconducting rectangular waveguide sections each comprised of single crystal high Tc superconducting materials;

said first, second, third . . . , n high Tc superconducting rectangular waveguide resonators each comprised of single crystal high Tc superconducting materials;

each of the said high Tc superconducting rectangular waveguide irises comprised of single crystal high Tc superconducting materials;

each of said flanges comprised of single crystal high Tc superconducting materials; and means for keeping the band-stop filter at a high Tc superconducting temperature.

4. A high Tc superconductor band reject filter of claim 3 wherein the high Tc superconducting material being a single crystal YBCO.

5. A high Tc superconducting rectangular waveguide resonator band pass filter, comprised of a single crystal dielectric material having conducting surfaces on which are deposited a film of a single crystal high Tc superconductor, having an input at one end and an output at the other end, a center for each resonator therebetween and comprising of:

a body of a high Tc superconducting rectangular waveguide main transmission line;

a first high Tc superconducting transmission means for coupling RF energy into said body at the input;

a first high Tc superconducting rectangular waveguide resonator, typically being one half of a guide wavelength long and being part of the said main transmission line, with irises;

a second high Tc superconducting rectangular waveguide resonator, typically being one half of a guide wavelength long and being part of the said main transmission line, with irises;

a first high Tc superconducting rectangular waveguide section connected between the first and the second waveguide resonators providing a separation between the centers of the resonators being typically three quarters of a guide wavelength long;

a third, fourth . . . , n high Tc superconducting rectangular waveguide resonators, each waveguide resonator typically being one half of a guide wavelength long and being part of the said main transmission line, with corresponding irises;

a second, third . . . , (n−1) high Tc superconducting rectangular waveguide sections, providing a respective separation between the centers of successive adjacent waveguide resonators of typically three quarters of a guide wavelength long, being connected to successive waveguide resonators, being part of the main transmission line, and being connected with the second waveguide resonator;

flanges being connected at the input and at the output of the filter on the main transmission line;

a second RF high Tc superconducting transmission means for coupling energy from said body at the output;

said first, second, third . . . , (n−1) high Tc superconducting rectangular waveguide-sections each comprised of good quality single crystal dielectric materials and deposited on said conducting surfaces with a film of a single crystal high Tc superconducting material;

said, first, second, third . . . , n high Tc superconducting rectangular waveguide resonators each comprised of good quality single crystal dielectric materials and deposited on said conducting surfaces with a film of a single crystal high Tc superconducting material;

each of the said high Tc superconducting irises comprised of good quality single crystal dielectric materials and depositing on said conducting surfaces with a film of a single crystal high Tc superconducting material;

each of said flanges comprised of good quality single crystal dielectric materials and depositing on said conducting surfaces with a film of a single crystal high Tc superconducting material;

means for keeping the high power band-pass filter at a high Tc superconducting temperature.

6. A high Tc superconductor band pass filter of claim 5;

the said high Tc superconducting material being a single crystal YBCO; and the said dielectric material being a single crystal sapphire.

* * * * *